US005592829A

United States Patent [19]

Kim

[11] Patent Number: 5,592,829

[45] Date of Patent: Jan. 14, 1997

[54] REFRIGERATOR PROVIDED WITH A CONDENSER HAVING AN IMPROVED COOLING EFFICIENCY

[75] Inventor: Byung-Sun Kim, Seoul, Rep. of Korea

[73] Assignee: Daewoo Electronics Co., Ltd., Seoul, Rep. of Korea

[21] Appl. No.: 424,744

[22] Filed: Apr. 18, 1995

[30] Foreign Application Priority Data

Apr. 21, 1994 [KR] Rep. of Korea ..... 94-8429

[51] Int. Cl.[6] ..... F25D 17/06

[52] U.S. Cl. ..... 62/428; 165/67

[58] Field of Search ..... 62/306, 307, 308, 62/298, 428; 165/67, 906

[56] References Cited

U.S. PATENT DOCUMENTS

| | | | |
|---|---|---|---|
| 1,541,754 | 6/1925 | Spreen | 62/507 |
| 1,849,793 | 3/1932 | Dennison | 62/508 |
| 2,115,288 | 4/1938 | Smith | 62/428 |
| 2,187,066 | 1/1940 | Youker | 62/428 |
| 2,218,596 | 10/1940 | Ashley | 62/507 |
| 2,311,947 | 2/1943 | Kucher | 62/508 |
| 2,779,173 | 1/1957 | Wurtz | 62/508 |
| 3,500,657 | 3/1970 | Johnson | 62/428 |
| 3,524,329 | 8/1970 | Smith et al. | 62/508 |

*Primary Examiner*—William Doerrler
*Attorney, Agent, or Firm*—Anderson Kill & Olick P.C.

[57] ABSTRACT

In a refrigerator of the type comprising a compressor, a condenser, a fan motor for sucking in a coolant air and a casing supporting said fan motor, the fan motor being positioned between the compressor and the condenser, the refrigerator characterized in that said condenser has a generally coil-shaped configuration. The refrigerator further comprises a counterpart casing mounted on a bottom plane of a machinery room in the refrigerator to slightly depress the coil-shaped condenser against the casing and a support bracket connecting the two casings above the condenser.

1 Claim, 4 Drawing Sheets

REFRIGERATOR PROVIDED WITH A CONDENSER HAVING AN IMPROVED COOLING EFFICIENCY

FIELD OF THE INVENTION

The present invention is directed to a refrigerator; and, more particularly, to a refrigerator with a condenser capable of providing an improved cooling efficiency.

DESCRIPTION OF THE PRIOR ART

A compressor and a condenser incorporated in a refrigerator are conventionally located in rear lower parts of the refrigerator and are subjected to a high temperature due to the heat emanating from the compressing or condensing operation thereof. In order to dissipate said heat generated from the compressor and condenser, the refrigerator is normally equipped with a fan driven by a motor.

FIG. 1 shows a condenser cooling unit of the type including a fan 5 which serves to suck in outside air into an inside space 2. As indicated with an arrow, the outside air having a relatively lower temperature than the inside temperature blows toward a compressor 3 through a condenser 4 to thereby cool these members 3 and 4. A numeral 1 is assigned to indicate the housing of the refrigerator.

In this type of condenser cooling unit, the cooling efficiency of the compressor or condenser is affected by the shape and structure of the condenser.

In FIGS. 2A and 2B, there are shown prior art condensers for use in refrigerators of the type employing a condenser cooling unit described above. The condenser 6 shown in FIG. 2A is structured to have a plurality of straight portions 6*b* and curved portions 6*a*; and the condenser 7 shown in FIG. 2B has a plurality of heat exchange fins 7*a* arranged in association with straight portions thereof 7*b*.

However, the prior art condensers described above have a limited cooling efficiency, since they are structured to restrict the flow of the coolant fluid, e.g., air. That is, when the outside air as the coolant is introduced into the inside space, the coolant air meeting a frontal plane of the condenser will have to pass round the condenser (see FIG. 1) rather than pass through the spaces between the straight portions of the condenser. Accordingly, only a partial cooling action may be performed on the condenser by the coolant air.

Further, as the coolant air having passed around the condenser has a tendency to flow toward the flank portions of the compressor only, it will also have a reduced cooling effect on the compressor.

Moreover, since the prior art condensers have rather complicated structures having a plurality of straight and curved portions and/or heat exchange fins, it is difficult to automate the manufacturing process thereof.

SUMMARY OF THE INVENTION

It is, therefore, a primary object of the invention to provide a condenser for use in a refrigerator which is structured to provide an improved cooling efficiency of the condenser and a compressor associated therewith.

Another object of the present invention is to provide a condenser for use in a refrigerator which is simple in structure and easy to automate the manufacturing thereof, to thereby reduce the manufacturing costs thereof.

The above and other objects of the invention are accomplished by providing an improved refrigerator of the type including a compressor, a condenser, a fan motor for directing the flow of a coolant air and a casing which supports the fan motor, the fan motor being positioned between the compressor and the condenser, wherein said improvement comprises said condenser having a generally coil-shaped configuration along the flow direction of the coolant air.

The inventive refrigerator further comprises a counterpart casing disposed in an opposite side of said casing about the condenser for slightly depressing the condenser against the casing, the counterpart casing having an intake hole and a plurality of intake slots through which the coolant air flows into.

The inventive refrigerator further comprises a support bracket mounted above the condenser for connecting the casing with the counterpart casing.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
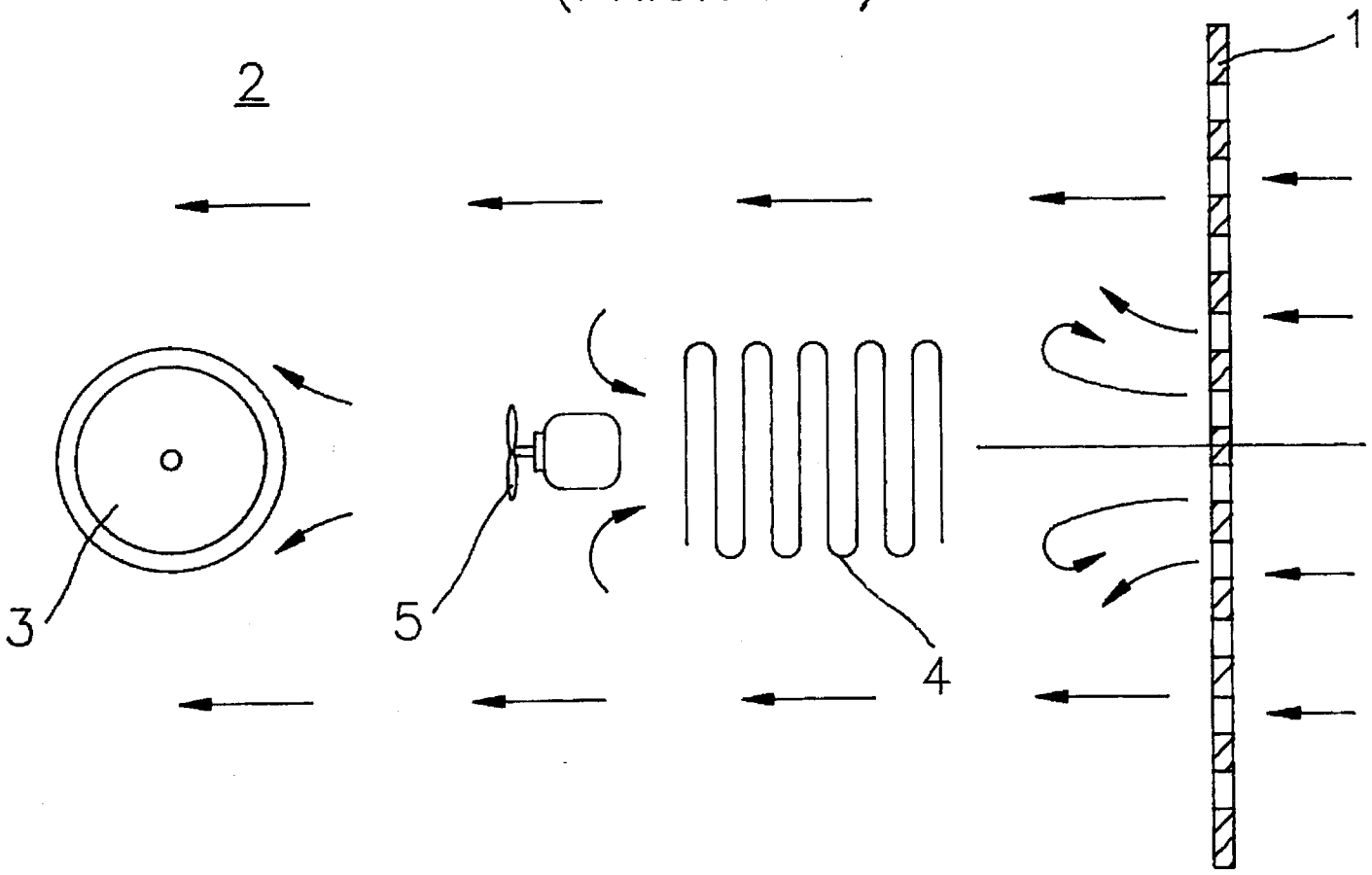
FIG. 1 (PRIOR ART)
FIG. 1 represents a schematic top view for explaining a condenser cooling unit of a conventional refrigerator.
Figure 2A:
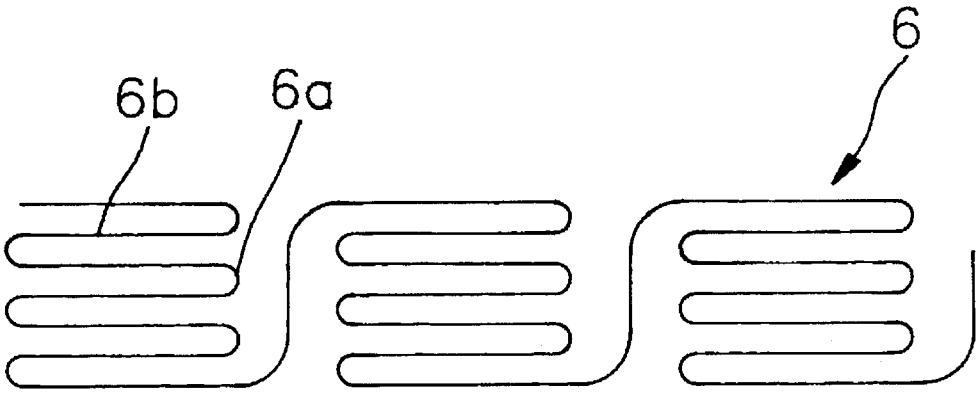
FIG. 2A (PRIOR ART)
FIGS. 2A and 2B show schematic views of prior art condensers for use in a refrigerator of the type including the condenser cooling unit shown in FIG. 1.
Figure 2B:
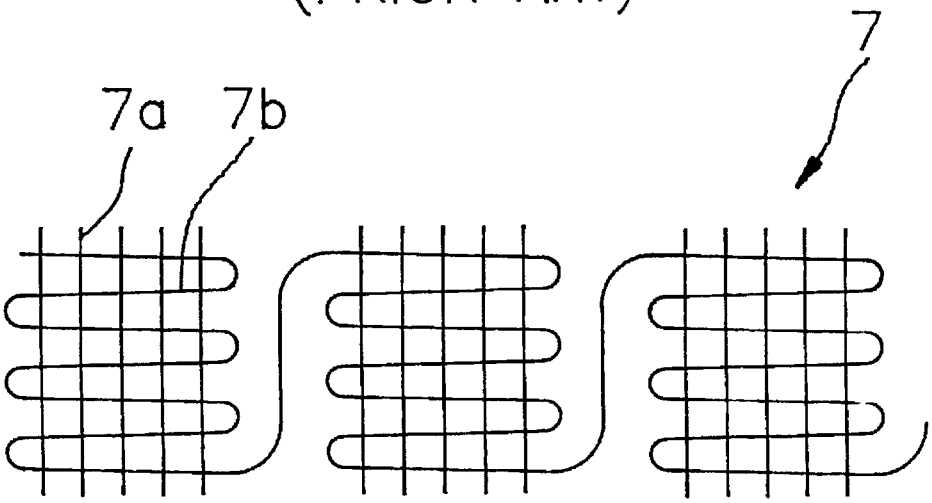
FIG. 2B (PRIOR ART)
Figure 3:
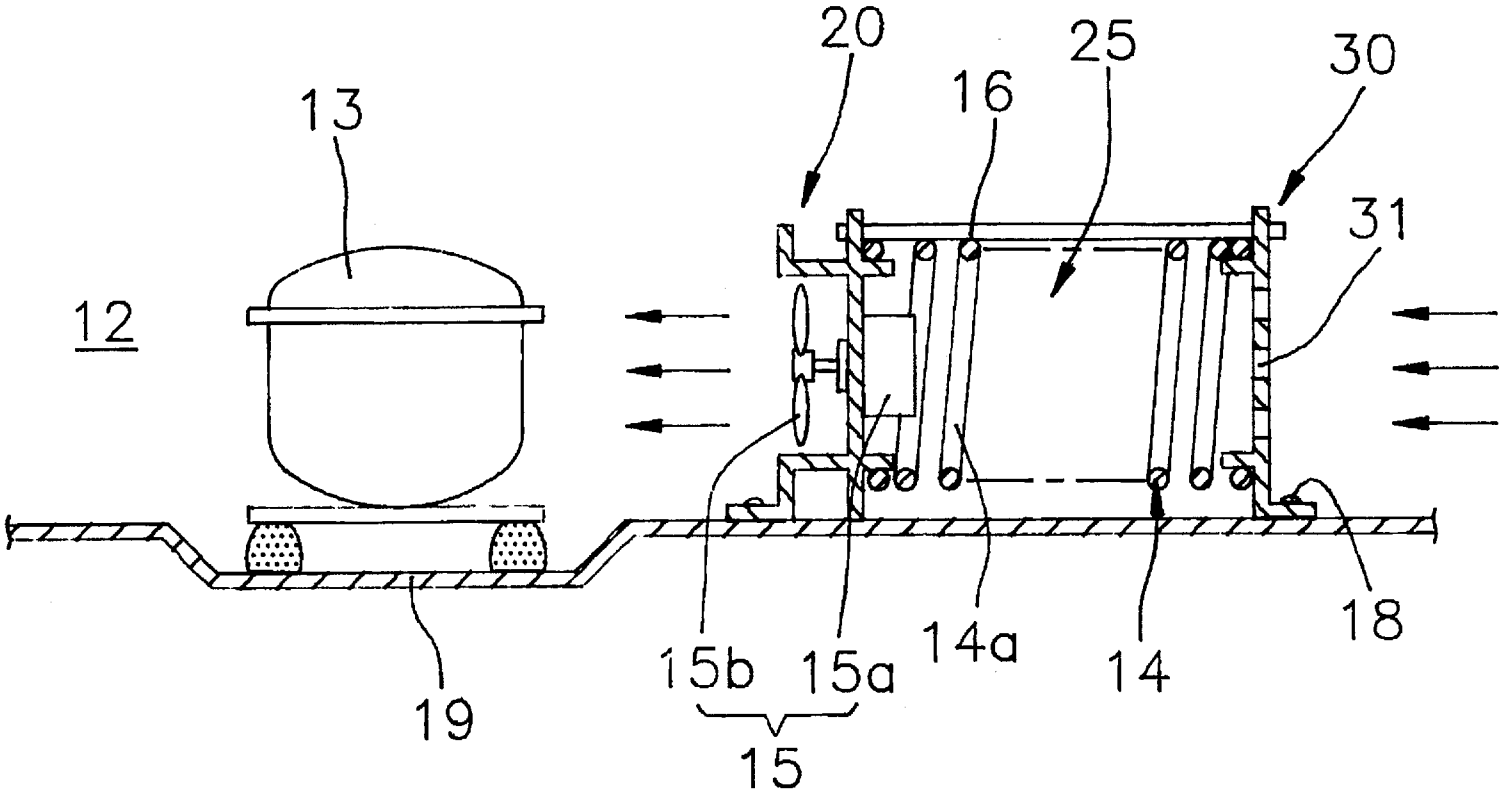
FIG. 3 illustrates a schematic front view of a refrigerator condenser cooling unit employing an inventive condenser.
Figure 4:
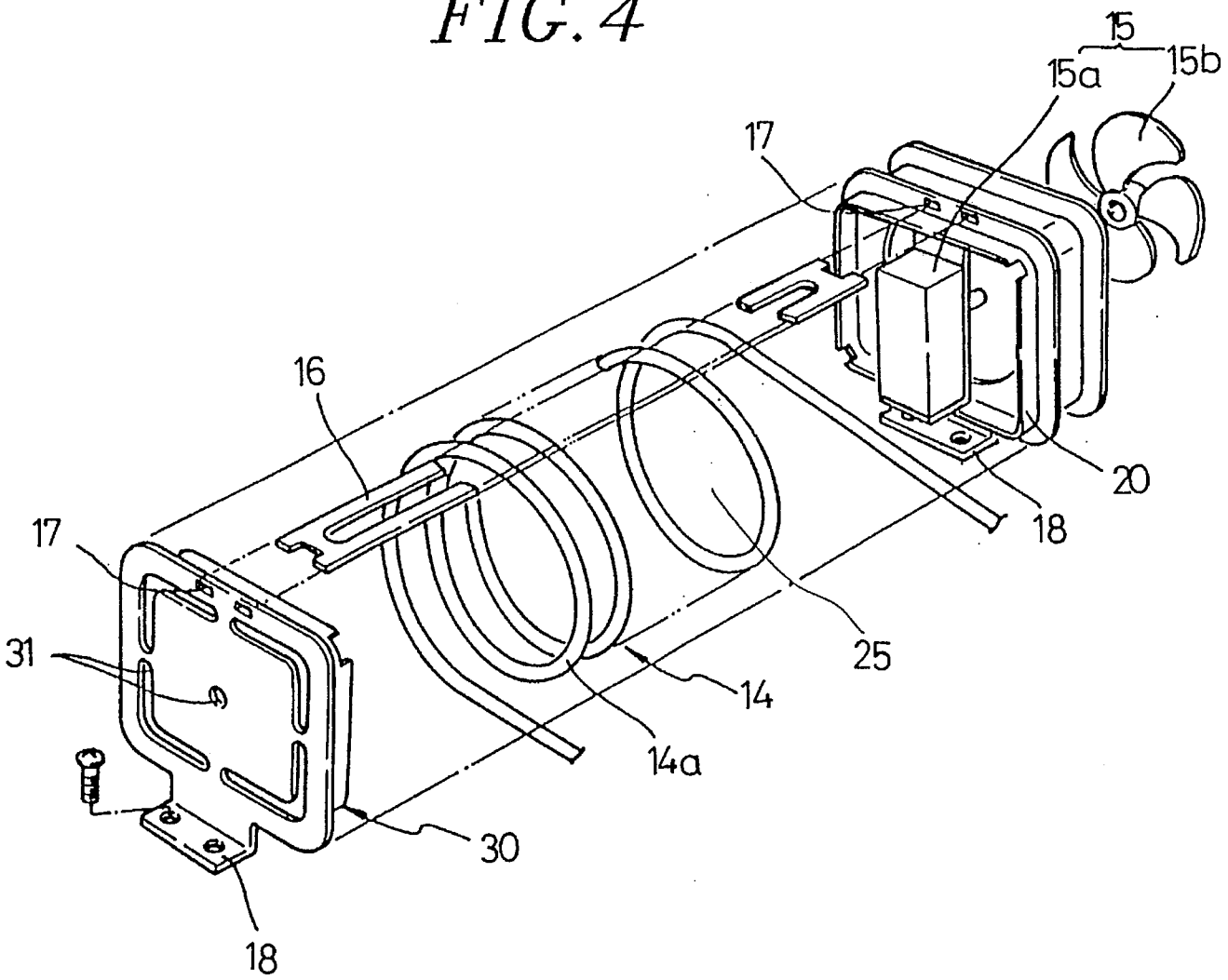
FIG. 4 presents an exploded perspective view of the condenser for use in a refrigerator in accordance with the present invention.

Referring to FIGS. 3 and 4, a compressor 13 and an inventive condenser 14 are installed in a machinery room 12 of a refrigerator. Mounted between the compressor 13 and the condenser 14 is a fan motor 15 which consists of a fan 15*b* and a motor 15*a* driving the fan 15*b*. The fan motor 15 sucks in air into the machinery room 12 to cool the compressor 13 and the condenser 14. As indicated with a plurality of straight arrows, the outside air having a lower temperature than the inside temperature of the machinery room 12 passes through the condenser 14 and then meets the compressor 13.

As best illustrated in FIG. 4, the inventive condenser 14 has a generally coil-shaped configuration along the flow direction of the coolant air. The coiled configuration of the condenser 14 enables the coolant air to traversely flow through a tunnel portion 25 without interruption. The coil-shaped condenser 14 can be manufactured in a highly automated manner so that a copper tube 14*a* of a small diameter is continuously wound into a coil-shaped configuration by using a suitable machine and then is cut to a desired length.

A casing 20, to which the motor 15*a* is attached, is disposed on a bottom plane 19 of the machinery room 12 in the vicinity of the condenser 14.

A counterpart casing 30 is disposed on the bottom plane 19, in an opposite side of the casing 20 with the condenser 14 disposed therebetween. The counterpart casing 30 serves to slightly depress the condenser 14 against the casing 20 so that the condenser 14 is kept immovable between the casing 20 and the counterpart casing 30. The counterpart casing 30 has an intake hole and a plurality of intake slots 31 through which the coolant outdoor air is flowed into the machinery room 12 (see FIG. 3). It is preferable that the configuration of the counterpart casing 30 be similar to that of the casing 20.

Mounted above the condenser 14 is a support bracket 16 which ensures the combined fixing action of the casing 20 and the counterpart casing 30 and prevents an unwanted movement of the condenser 14. The support bracket 16 may be constructed to extend from either one of the casing 20 and the counterpart casing 30 in accordance with a preferred embodiment of the present invention.

In accordance with another embodiment, the support bracket 16 may be made as a separate member, both ends of which are adapted to be closely fitted into throughholes 17 of the casing 20 and the counterpart casing 30.

Alternatively, a welding method or the like, between a lower surface of the support bracket 16 and upper portions of the coil-shaped condenser 14 adjacent to the lower surface of the support bracket 16 may be employed to prevent the condenser 14 from any unwanted movement.

The casings 20 and 30 further comprise flanges 18 having threaded holes so that the two casings 20 and 30 are joined to the bottom plane 19 of the machinery room 12 by threads.

Referring to FIG. 3, when the fan motor 15 is energized, outside air having a relatively lower temperature is flowed into the machinery room 12 through the intake slots and hole 31 of the counterpart casing 20. The air flow effectively cools the coil-shaped condenser 14 and then heads directly toward the compressor 13 for an effective cooling thereof.

Although the invention has been shown and described with respect to the preferred embodiments, it will be understood by those skilled in the art that various changes and modifications may be made without departing from the spirit and scope of the invention as defined in the following claims.

What is claimed is:

1. In an improved refrigerator of the type including a compressor, a fan motor for directing the flow of a coolant air and a casing which supports the fan motor, wherein said improvement comprises:

a condenser having a generally coil-shaped configuration along the flow direction of the coolant air;

a counterpart casing disposed in an opposite side of said casing about the condenser for slightly depressing the condenser against the casing, the counterpart casing having an intake hole and a plurality of intake slots through which the coolant air flows into; and a support bracket mounted above the condenser for connecting the casing with the counterpart casing.

* * * * *